United States Patent [19]

Frank

[11] 3,945,229

[45] Mar. 23, 1976

[54] BAR-TUMBLER TYPE SAFETY LOCK

[76] Inventor: Roger Frank, rue General Ferrie, 74300-Cluses, France

[22] Filed: Dec. 27, 1973

[21] Appl. No.: 428,820

[30] Foreign Application Priority Data

Dec. 29, 1972 France ..... 72.46867

[52] U.S. Cl. ..... 70/363; 70/369; 70/DIG. 60

[51] Int. Cl.[2] ..... E05B 27/08

[58] Field of Search ..... 70/363, 362, DIG. 60, 369, 70/368

[56] References Cited

UNITED STATES PATENTS

| | | | |
|---|---|---|---|
| 2,391,834 | 12/1945 | Johnstone | 70/363 |
| 2,557,028 | 6/1951 | Deutsch | 70/363 |
| 2,677,266 | 5/1954 | Hagstrom | 70/369 |
| 3,399,555 | 9/1968 | Gray | 70/369 |
| 3,408,840 | 11/1968 | Hasenbein | 70/363 |
| 3,605,461 | 9/1971 | Frank | 70/363 |

*Primary Examiner*—Robert L. Wolfe

*Attorney, Agent, or Firm*—Larson, Taylor and Hinds

[57] ABSTRACT

Disclosed is a bar-tumbler type safety lock, as well as a key and a coding process for said lock. According to a single-key-entry embodiment, this lock comprises a body, a two-piece washer, a latch holder and a barrel having recesses in which notched tumblers can slide and which is maintained rotatingly and removably toward the front of said body by a stud and a stopping finger retained in two annular slots made radially in this body and which can be retracted by the introduction of a special extraction key into the lock; the coding of the lock is obtained by the forming, in the annular washer-assembly groove, of notches simultaneously in each of the tumblers by a conventional turning process, with the key inserted.

13 Claims, 9 Drawing Figures

BAR-TUMBLER TYPE SAFETY LOCK

Figures 1, 2:
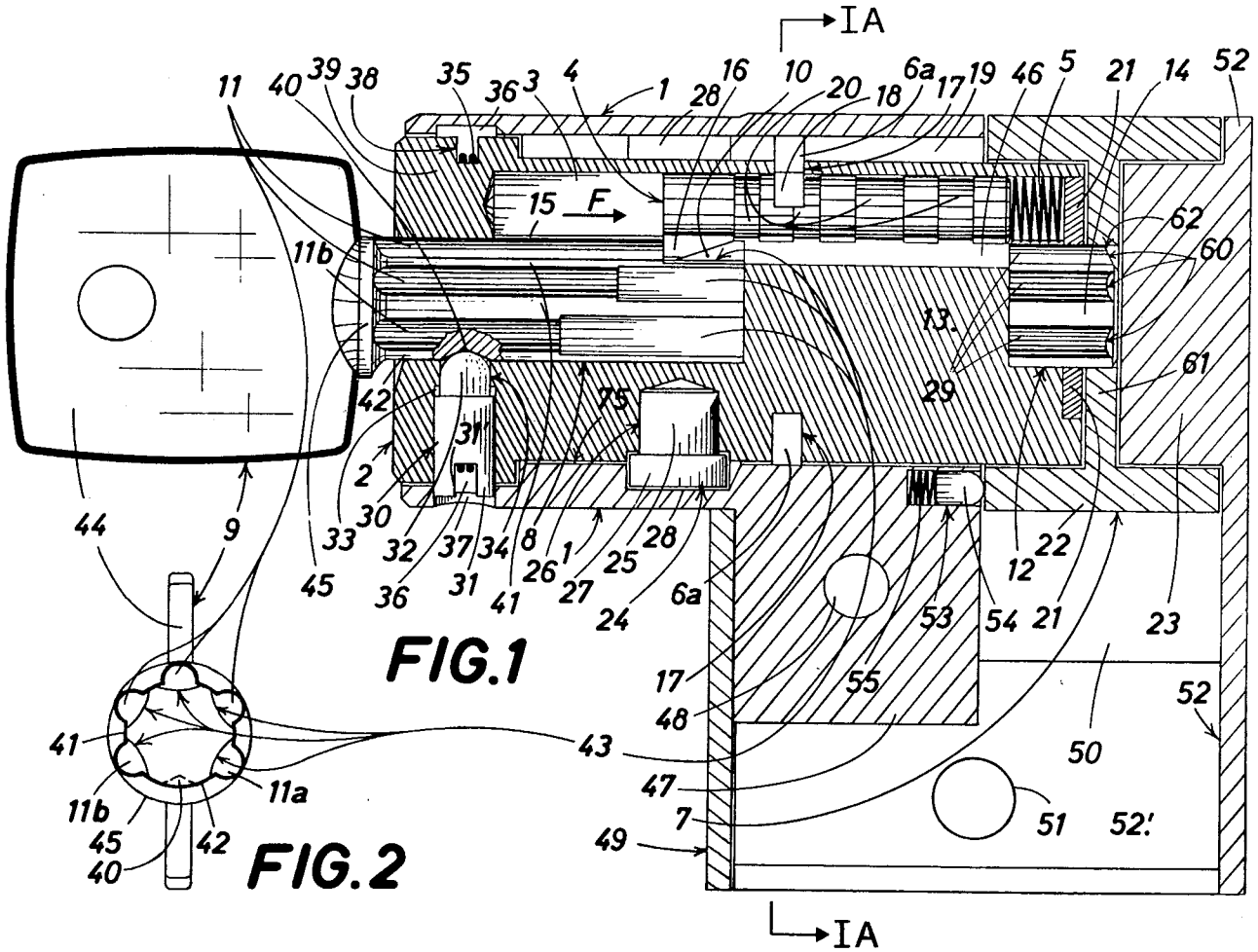

This invention relates to a bar-tumbler type safety lock of the type known as a Bramah lock, more particularly designed to be manufactured in very large series, in a small diameter, of the order of a centimeter, in which the rapid assembly of the constituent elements does not require any screwing and in which the easily modifiable combination(s) are formed with great accuracy and in a simple manner directly from those on the operating key(s). The invention also relates to a key for the operation of this lock and to a process for coding this lock.

It is known that in bar-tumbler locks, the rotation of the key, producing that of the latch holder, is possible only when the notches made in the tumblers mounted to slide longitudinally in the periphery of the barrel are aligned opposite the radial teeth of a member called the washer. This alignment takes place only if the combination on the key introduced into the lock, represented by a suitable length of each of its splines by means of which the tumblers are put into position, corresponds to the combination or at least to one of the combinations of the lock which are represented by the positions of the said notches in the tumblers. In the opposite case, at least one of the tumblers remains blocked laterally between two successive teeth of the washer which then opposes the rotation of the barrel and of the key. These locks are most often relatively large in size, delicate in operation and, especially, involving complex machining and assembly resulting in a high cost. In particular, as the forming of the notches in the tumblers is done independently of the splines on the key, it is necessary to code, with discretion, not only the lengths of the splines of the key but also the corresponding positions of the notches formed in the tumblers, and then to associate with each of the keys a given selection of these tumblers, consequently requiring the storage of a large variety of tumblers with different notching and favouring the risk of error in their selection for the equipment of the lock associated with a given key. Moreover, the changing of the combination of these locks, for example following the loss of their key, is not easy. It is possible only by completely disassembling the lock removed from its recess.

Owing to its simple, new and original design, the lock according to the invention overcomes the drawbacks and constraints mentioned above and offers both great robustness and a high level of safety. This lock can be of the single or double type depending on whether the door is to be opened from one or both sides. In the first case, it is particularly intended to be mounted in a blind orifice made in one of the sides of a door to be locked on one side only whereas in the second case, it can be mounted in an orifice made on either side through a door to be locked either from the inside or the outside.

It comprises, in a known manner, at least one hollow body, a rotating barrel mounted co-axially within this body and the periphery of which is provided with longitudinal recesses in each of which slides a tumbler, in opposition to return means, a washer split into two parts and a latch holder driven at least indirectly by the barrel.

This lock is characterised by the fact that the barrel, going longitudinally through the body and in the front part of which the key is directly engaged, is kept from moving frontward in the said body by retractable longitudinal retaining means; and by the fact that the middle part of this barrel is provided with a radial annular groove whose width is at most equal to that of the notches made in the tumblers and in which are grouped the two halves of the washer held together by an internal broaching of the body in which the washer is rotatingly blocked but allowed to slide longitudinally, driven by the barrel during the extraction or the introduction of the latter into the body.

In a preferred manner, with the barrel pierced with a central key-reception channel open toward the front and broached to the profile of the key, and the longitudinal plane of symmetry of which is that of the barrel, the said longitudinal means for retaining the barrel in the body consist of a stud engaged in a blind hole made radially in the periphery of the barrel along its lower half-plane of symmetry and the head of which emerges radially from the barrel; of a first annular slot made radially in the internal surface of the body and in which slides, while held captive longitudinally during the major part of the rotation of the barrel, the head of this stud; of a rectilinear slot made at the bottom of one of those constituting the broaching of the body and which, leading into the first annular slot and coming out at the front of the body, allow, by the sliding of the head of this stud in this rectilinear slot, the withdrawal of the barrel toward the front, for a given angular position of the latter with respect to the body; of a stop finger mounted slidingly in a shaft made radially through the front part of the barrel along the lower half-plane of symmetry of the barrel and opening on the said central channel, this stop finger being retractable in this shaft, in opposition to return means loading it toward the axis of the said channel; of a second annular slot made radially in the front part of the internal surface of the body, at the level of the said shaft when the barrel is in place, and in which, with the key fully engaged, is secured the base of the said finger which then retains the barrel inside the body, even in the said given angular position of the latter, angular position in which the barrel can be taken out of the body only by introducing a special extraction key which, offering no resistance to the finger return means, allows them to maintain the base of this finger disengaged from this second annular slot.

Also in a preferred manner, means for locking the key inside the barrel during the operation of the lock consist of a hollow of small depth made radially in the key at the level of its lower generatrix; the said stopping finger; the said second annular slot and one or more orifices for the exterior disengagement of the base of this finger in opposition to its return means, pierced at the bottom of this second annular slot, the first along the lower half-plane of symmetry of the body, the others each at the level of the bottom of one of the slots constituting the broaching of this body; the assembly is arranged so that the key inserted in the barrel retracts the finger in the shaft, the base of this finger engaging one of these orifices, and then when fully engaged in the barrel, allows the head of the finger to engage in the said hollow and allows the base of the finger to become disengaged, under the action of its return means, from this orifice and to be maintained by the bottom of the second slot, the key remaining locked by the finger during the rotation of the barrel from which the key is disengaged only in an angular position of the barrel in which the finger is aligned with another orifice or, after a complete rotation of the barrel, with the same orifice, thereby allowing the finger to retract before the key which can only then be removed from the barrel.

In another preferred manner, the barrel having a length greater than that of the body, the latch holder turns in the manner of a sleeve on the rear end of the barrel which drives it rotatingly indirectly through a drive member or driver engaged rotatingly with the barrel in an internal broaching of the rear part of the barrel; means are provided for angularly maintaining the latch holder in position when the barrel is removed from the body.

In another preferred manner, the said longitudinal recesses in which the tumblers slide are blind cylindrical holes opening at the rear of the barrel, and these tumblers are massive cylindrical blocks the front part of which laterally carries a nib on which acts the corresponding spline of the key and in the body of each of which, in addition to one or more coding notches, are radially provided several annular grooves constituting false notches intended to mask the real position of the coding notch(s) of the tumbler when an attempt is made to pick the lock; the said tumbler return means being composed of helical springs each placed in one of the said recesses, directly behind the tumbler, and retained at the bottom of the recess by an annular member or retainer which simultaneously blocks all these recesses behind the barrel in which this retainer can be crimped and which is provided with a central opening traversed by the driver.

In accordance with a first preferred embodiment of the invention, the single lock is provided with a single body and a single barrel and is characterised by the fact that the central channel of the barrel, in which the key is directly inserted from the front, is separated from broaching made in the rear part of this barrel by a massive partition on the front face of which bears directly the end of the key fully engaged in the barrel and the periphery of which is only pierced with longitudinal hollows in which the tumbler nibs can engage, said hollows being extended toward the front by longitudinal ports which place each of said recesses of the tumblers in communication with the central channel and in which are guided and slide these tumbler nibs.

According to this first preferred embodiment, the lock can moreover be characterised by the fact that the driver is partially crimped permanently in the internal broaching of the rear part of the barrel and, with the latter in place, is maintained engaged in an identical broaching made in the central part of the latch holder, the latter being maintained rotatingly on a face of the bottom of the lock.

According to a second preferred embodiment of the invention, the double lock is provided with two bodies and two barrels each mounted in one of the bodies and is characterised by the fact that the central channel of each of these two barrels, the broaching of which reproduces the profile of the splines on the key, extends longitudinally over the entire length of the barrel and has a radial inset which separates the said central channel into two parts, one in front and in which the key is directly inserted from the front, the other behind and opening at the back of the barrel and in which is slidingly mounted the driver which is provided with splines of the same profile as those of the key and is fixed on the tail of a pushing member whose middle part slides in the said radial inset and whose head, against which bears the end of the key, is retained in the said front part by the said inset when the key is fully engaged; a helical spring, placed in the rear part of the central channel of one of the two barrels, around the middle part of the pushing member and compressed between the said radial inset and the driver, tending to maintain this latter engaged in a broaching, identical to that of the central channel, made in a diametral partition of the latch holder which, having a symmetrical configuration, turns in the manner of a sleeve on the rear end of each of the two barrels; the assembly is arranged so that, with the barrels in place, the latch holder is maintained, in the absence of the key, engaged with one of the two barrels which is provided with the said helical spring, remains engaged with the latter when the key is engaged in this first barrel and is disengaged from this latter to be engaged with the second barrel under the action of the key inserted fully into this second barrel whose driver, driving that of the first barrel in opposition to the said helical spring, then engages, while held by the key, in the latch holder; means are provided for keeping the two bodies assembled.

The key according to the invention is made up, in a known manner, of a cylindrical massive body on the periphery of which are made several splines, truncated at their end over a depth depending on the combination carried by this key and regularly distributed angularly, a higher angular distance being allowed at the base of this body between the first and the last of these splines.

This key is characterised by the fact that the said splines have an arched cross section and by the fact that a hollow of small depth, intended to receive the head of the stopping finger locking the key in the barrel, is made radially in the said key body along its lower generatrix; profiles formed longitudinally in this body in front of each of the splines, resulting from their truncation for the coding of the key.

The lock coding process according to the invention is characterised by the fact that, with the barrel extracted from the body, the said longitudinal recesses are equipped with unnotched tumblers, the key is fully engaged and held in the barrel and, by turning within the annular groove of the middle part of the barrel, the notches of the tumblers are simultaneously formed, that is, with the key in place, a conventional turning tool is inserted through the annular groove and the barrel is turned or rotated so as to form notches in all of the tumblers; the coding of the lock is thus achieved quickly and very accurately directly from the combination on the key the splines of which maintain the tumblers exactly in their position for the operation of the lock during the formation of their notches; other codes of the lock corresponding to the combinations of other keys, including at least one master key common to several locks and a special extraction key, being achievable by the successive formation of notches in the same tumblers of the lock.

As a variant of this coding process, the annular groove of the middle part of the barrel can be made by turning simultaneously with the formation of the notches of the tumblers corresponding to a first coding of the lock, that is, the turning tool can be used to form the annular groove and then, as the tool extends inwardly through the groove so formed, to form the notches in the tumblers.

The invention will be better understood and other features and advantages will more clearly appear through the following description and to the appended drawing referring to two preferred embodiments of the said invention given by way of nonlimitative examples.

Figures 1A, 3:
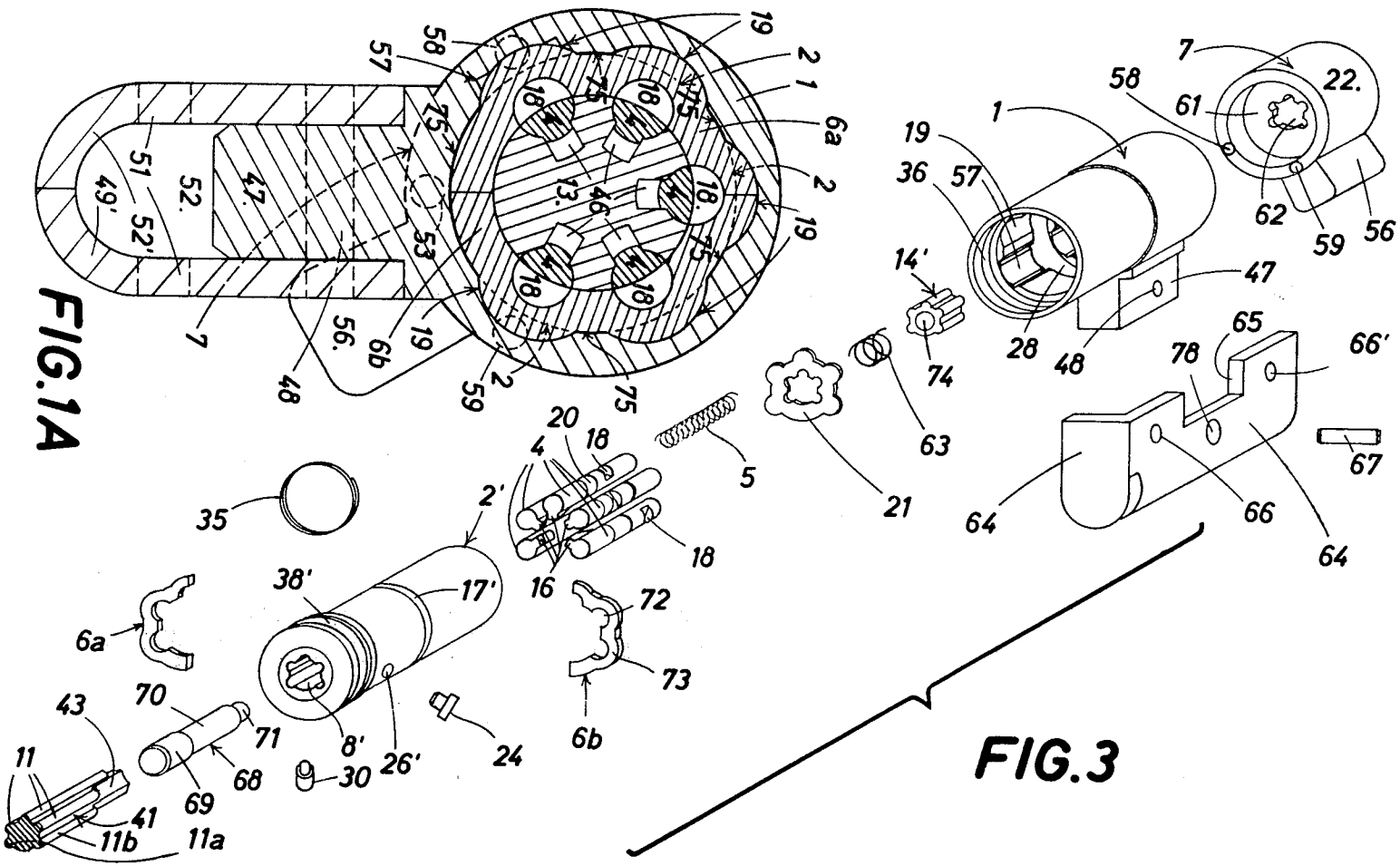
Figure 4:
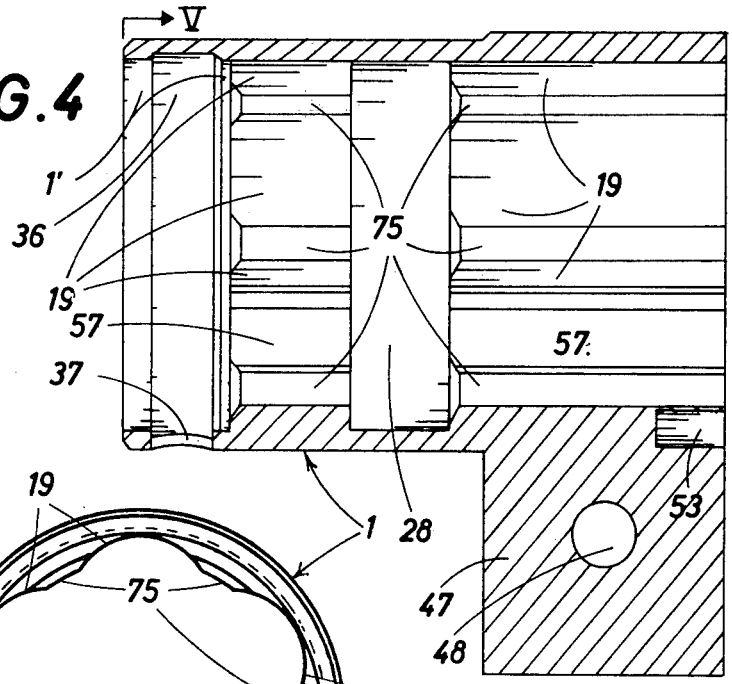
Figure 5:
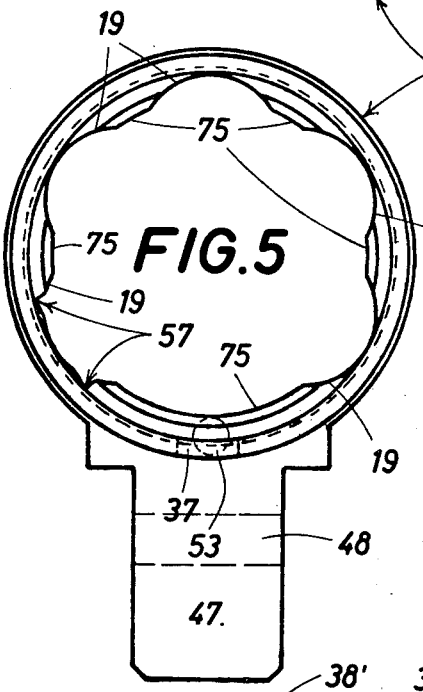
Figure 7:
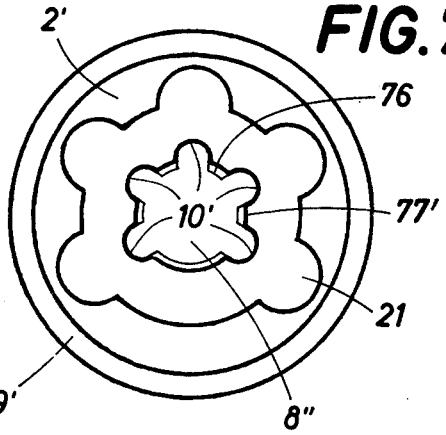
Figure 6:
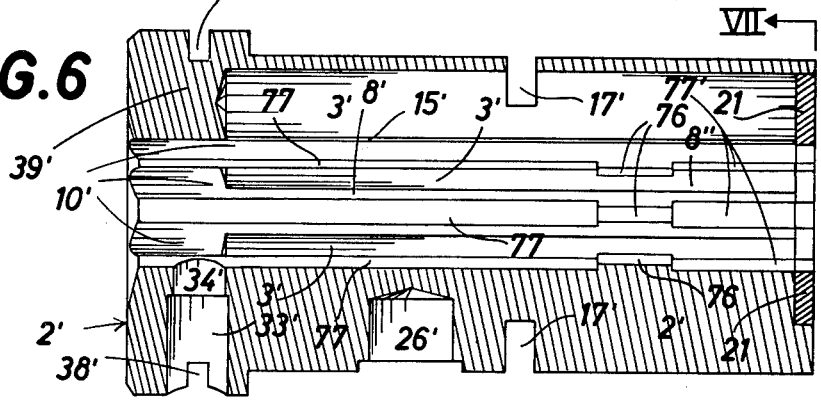
Figure 8:
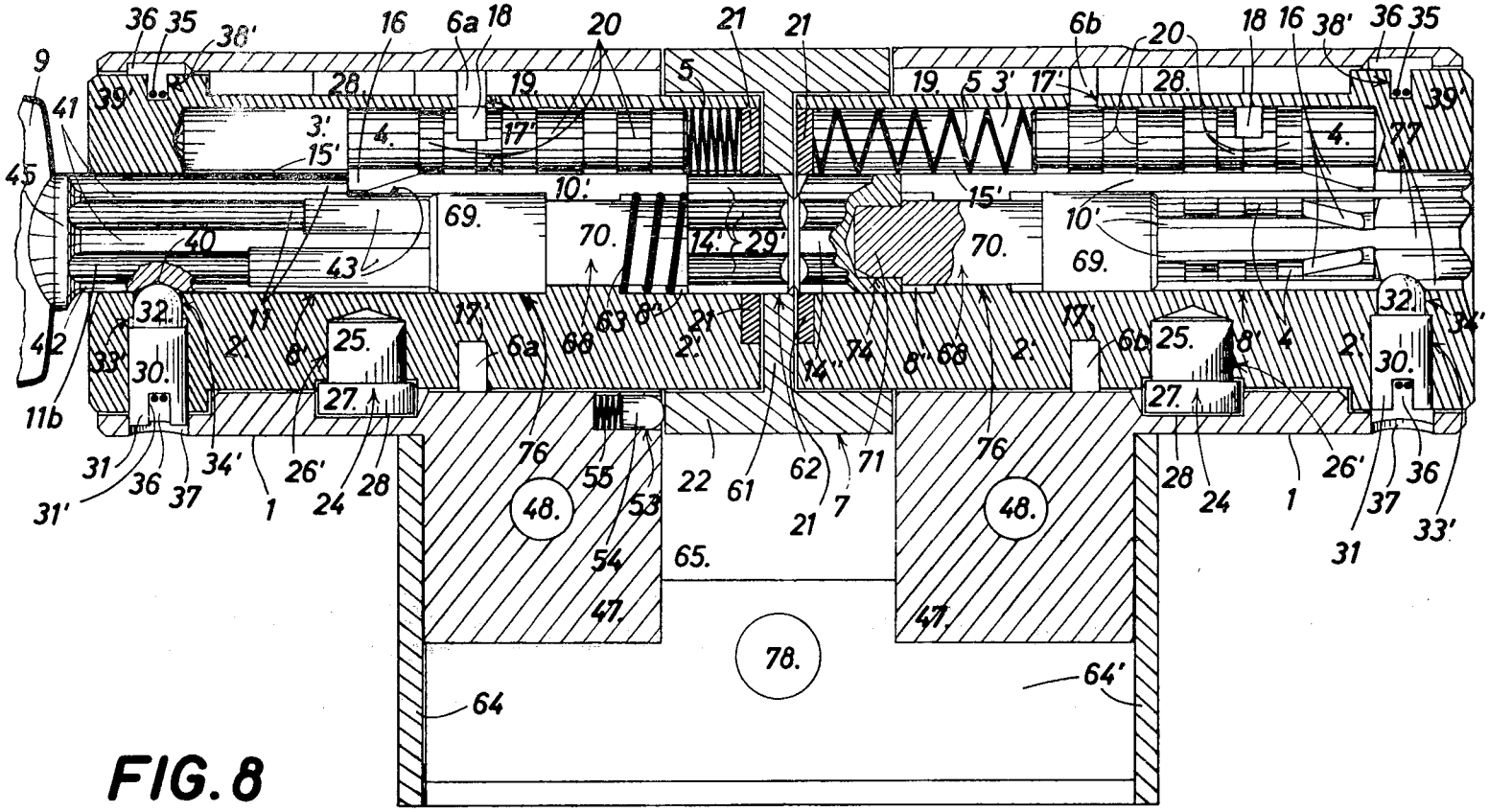

In the drawing:

FIG. 1 represents, in longitudinal section, a single lock in accordance with the first preferred embodiment of the invention, FIG. 1A is a cross section of this lock along IA-IA of FIG. 1, FIG. 2 shows, seen from the end or "from profile", the key used for operating the lock according to the invention, FIG. 3 is an exploded view showing the different components making up one of the two halves of a double lock according to the second embodiment of the invention, FIG. 4 represents, in longitudinal section, the or one of the two bodies of the lock according to the first or, respectively, the second embodiment of the invention, FIG. 5 shows this body seen from the front along V of FIG. 4, FIG. 6 represents, in longitudinal section, one of the two barrels of the lock according to the second embodiment of the invention, FIG. 7 shows the bottom of this barrel along VII of FIG. 6 and, FIG. 8 is a longitudinal section of this lock according to the second embodiment of the invention.

Referring first of all to FIGS. 1, 1A, 4 and 5 and according to the first embodiment, comprising a single key entry, the lock according to the invention comprises a body 1, a rotating barrel 2 mounted co-axially within this body 1, a washer split in two parts 6*a* and 6*b* and a latch holder 7 driven indirectly by this barrel 2 made to rotate by a key 9 introduced directly from the front into this barrel 2. The body 1 comes in the form of a cylindrical sleeve extended radially at its rear part by an external attachment fin 47 and traversed by the barrel 2. The front of this body 1 has an entry bore 1′ in which fits the front part 39 of the barrel 2 which is mounted rotatingly in a central bore 75 of smaller diameter made at the back of the first bore 1′ along the entire length of this body 1. This bore 75 is broached radially to provide five longitudinal slots 19 of arched section. These five slots 19 are distributed angularly by sixty degrees from the lower generatrix of the body 1, an annular spacing of one hundred and five degrees separating the first slot from the fifth slot 19, arranged with respect to each other symmetrically in relation to the plane of FIG. 1 which is the plane of symmetry of the lock. In the middle part of the body 1 a first annular slot 28 is made radially. A second annular slot 36 is made radially at the front of the body 1 in the entry bore 1′. A rectilinear slot 57 is made at the bottom and along the first of the slots 19 of the broaching of the body 1.

The periphery of the barrel 2 is provided with five longitudinal recesses made up of blind holes 3 open toward the back of the barrel and in each of which slides a tumbler 4. These recesses are distributed angularly by 60° from the lower generatrix of the barrel 2, a spacing of one hundred and five degrees separating the first and the fifth recesses, arranged symmetrically with respect to each other in relation to the plane of FIG. 1. Each of the tumblers 4 is made up of a massive cylindrical block whose front part is provided laterally with a nib 16 on which acts the corresponding spline 11 of the key 9 and in the body of each of which is made at least one coding notch 18 and, broached radially, several annular grooves 20 constituting false notches intended to mask the real position of the coding notch(s) 18 during an attempt to pick the lock. An annular member or retainer 21 simultaneously closes off all the five recesses 3 at the back of the barrel and can be crimped advantageously thereto. Between the back of each of the tumblers 4 and the retainer 21 is compressed a helical spring 5 which returns the tumbler, and which is fitted in the rear part of the corresponding recess 3. The middle part of the barrel 2 is provided with a radial annular groove 17 whose width is at least equal to that of the notches 18 made in the tumblers 4. The web of the barrel is pierced longitudinally with a central channel 8 opening toward the front and in which directly engages the key 9, and with a broaching 12 made in the rear part of this barrel 2. This central channel 8, broached to the profile of the key 9 has, as does the broaching 12, five longitudinal slots 10 having an arched cross section, distributed angularly by sixty degrees from the lower half plane of symmetry of the barrel 2, the first and fifth slot 10 being separated angularly by one hundred and five degrees. The central channel 8 and the broaching 12 are separated by a massive partition 13 on the front face of which directly bears the end of the key 9 engaged fully in the barrel. The periphery of this partition 13 is pierced with longitudinal hollows 46 in which can engage, set back, the nibs 16 of the tumbler 4. These hollows 46 are extended toward the front by longitudinal ports 15 which place each of the recesses 3 in communication with one of the slots 10 and in which are guided and slide these nibs 16.

The washer is split into two halves 6*a* and 6*b* which, grouped in the annular groove 17 of the barrel 2, give this washer the appearance of a ring with five arched crowns 73 each surrounding a circular hollow 72 in which slides one of the tumblers. These two halves of the washer appear clearly in perspective in the FIG. 3. They are maintained assembled in the broaching of the body in which the washer is blocked rotatingly but in which it can slide longitudinally owing to the engagement of the said crowns 73 in the slots 19 of this broaching.

The barrel 2 which is longer than the body 1 extends at the back of the latter and its rear part is engaged in the latch holder 7 which turns in the manner of a sleeve on this rear part of the barrel 2 and is driven indirectly by the latter through a driving member or driver 14 whose profile is advantageously the same as that of the key 9. This driver 14 is partially crimped in the broaching 12 and, with the barrel 2 in place, is kept engaged in an identical broaching 62 made at the centre of the latch holder, in the diametral partition 61 of the latter which is maintained rotatingly on a face 23 of the bottom 52 of the lock.

According to an essential characteristic of the invention, the barrel 2 is mounted removably toward the front in the body 1 of the lock, thereby making it possible, with the body 1, the latch holder 7 and the frame of the lock permanently fixed in the blind hole of a door, to easily accede, by removing the barrel, to the lock mechanism and, if necessary, to change the combination. For this purpose, the invention provides retractable means for longitudinally holding the barrel in the body, certain of which make it possible to lock the key in the barrel during the operation of the lock. They consist of a stud 24 engaged through its base 25 in a blind hole 26 made radially in the periphery of the barrel 2 along its lower half plane of symmetry and the head 27 of which emerges radially from the barrel 2;

these means also comprise the said first slot 28 made radially in the internal surface of the body 1 in which slides, while held captive longitudinally during the major part of the rotation of the barrel 2, the head 27 of this stud 24; said means also comprising the said rectilinear slot 57 made at the bottom of the first of these, 19, constituting the broaching of the body 1 and which, leading to the first annular slot 28 and coming out of the front of the body 1, allow, by sliding of the head 27 of this stud 24 in this rectilinear slot 57, the withdrawal of the barrel 2 toward the front for a given angular position of the barrel in relation to the body 1, which position is sixty degrees back from the plane of FIG. 1 in the considered example. These means moreover comprise a key stopping finger 30 mounted slidingly in a shaft 33 made radially through the front part 39 of the barrel 2 along the lower half plane of symmetry of the latter and opening on the central channel 8. This stopping finger 30 is retractable in this shaft 33 in opposition to an annular return spring 35 mounted in extension in a radial groove 38 made at the periphery of this front part 39 of this barrel 2. This annular spring 35, engaged in a slot 31' of the base 31 of the stopping finger 30 forces the latter toward the axis of the central channel 8. This finger 30 is held in this direction by the neck 34 of the shaft 33 in which only the head 32 of the finger 30 can slide. With the barrel 2 in place, the shaft 33 opens at the level of the second annular slot 36 the bottom of which is pierced with at least one orifice 37 in which can be disengaged externally the base 31 of the finger 30. A shallow hollow 40 is made radially in the body 41 of the key 9 at the level of its lower generatrix. This hollow is intended to allow the introduction of the head 32 of the finger 30 so as to maintain the base 31 of this finger disengaged from the orifice 37 when the key 9 is fully engaged in the channel 8 of the barrel 2. A special key, not shown, can be used to extract the barrel 2 from the body 1. Bearing the combination(s) of the lock, this special key is provided with a deeper hollow 40 than that of a normal key, making it possible to keep the base 31 of the stopping finger 30 completely disengaged from the second annular slot 36. With the barrel 2 initially in place, its withdrawal by means of this special key takes place in the following manner: with the key introduced fully in the central channel 8, the head 32 of the stopping finger 30 is engaged sufficiently into the hollow 40 of this special key to maintain the base 31 of the finger 30 disengaged from the second annular slot 36 under the action of the return spring 35. The splines of the special key place the tumblers 4 such that their notches are aligned with the washer, as with an ordinary key, thereby allowing the rotation of the key and of the barrel which is limited, in the considered example, to sixty degrees to the right (retrograde direction of trigonometry, with the lock seen from the front). The head 27 of the stud 24, having slid in the first annular slot 28 is positioned opposite the rectilinear slot 57 in which it then slides under the effect of the pulling of the key in the direction opposite to that of the arrow F, the barrel thus being easily removed from the body. Conversely, it is possible to introduce or to reintroduce the barrel 2 into this body 1 by previously engaging this special key fully into the channel 8 of the barrel 2 which is then presented in an angular position of sixty degrees in relation to the body 1 so as to enable the introduction of the head 27 of the stud 24 into the rectilinear slot 57. The barrel, pushed by the key, then progresses into the body 1 in the direction of the arrow F until this head 27 of the stud 24 reenters the first annular slot 28 and thus again retains the barrel in the body of the lock. With a normal key, the extraction of the barrel is prevented, even in the angular position of the barrel for which the head 27 of the stud 24 is opposite the rectilinear slot 57, by the engagement of the base 31 of the stopping finger 30 in the second annular slot 36, which engagement, radially blocking the finger 30 between the bottom of this second annular slot 36 and the hollow 40, locks the key 9 in the central channel 8 of the barrel 2 during the operation of the lock, the key 9 being unable to disengage until the stopping finger 30 can be retracted in the shaft 33, which, in the example shown in the drawing, is possible only when this finger 30 is aligned with the orifice 37 in which is then engaged, under the effect of the pulling of the key, the base 31 of the said stopping finger. Similarly, the introduction of the key into the channel 8, producing the initial retraction of the stopping finger 30, is obviously possible only when the barrel is in an angular position in relation to the body such that this stopping finger 30 is aligned with this orifice 37 or with another identical orifice which may also be pierced in the bottom of the second annular slot 36. It will in fact be noted that even though, in the example shown, the key 9 can be introduced or withdrawn from the barrel 2 only in a single angular position of the barrel in relation to the body, it is evidently possible, by providing other orifices such as the orifice 37, to introduce or withdraw the key according to the varied angular positions of this barrel 2 in relation to the body 1. Depending on utilisations, several possible disengagements of the key can be provided according to progressive angular positions of the barrel 2.

As the extraction of the barrel 2 leads to the disengagement of the driver 14 and of the latch holder 7, for a given angular position of the barrel 2 in relation to the body 1, it is essential, in order to be able to reintroduce the barrel into the body, engaged with this latch holder 7, that at the moment of the disengagement of this barrel, the latch holder 7 should be maintained angularly. For this purpose, it is possible to provide, as shown in the drawing, at least one shallow hollow 59 made in the front section of the cylindrical sleeve 22 of the latch holder 7 in which can be engaged, for the angular position of this latch holder 7 corresponding to that of the disengagement of the barrel 2, the rounded end of a retaining finger 54 mounted slidingly in a blind hole 53 of the fin 47 of the body 1, slightly forced against the said front section of the cylindrical sleeve 22 of the latch holder 7 by a return spring 55 fitted in this blind hole 53.

In order to facilitate the introduction of the driver 14 into the broaching 62 of the latch holder 7 during the placing of the barrel, the splines 29 of this driver 14, which in the example considered are cut to the profile of those of the key 9, each end in a chamfer 60.

The frame of the lock, which holds together the body 1 and the latch holder 7, comprises, in addition to the bottom 52, a front piece 49 and, integral respectively with this bottom 52 or this front piece 49, two cheeks 52' and 49' each notched at the back to form an opening 50 allowing the passage of the latch 56 (FIG. 3). An orifice 48 in the fin 47 of the body 1 allows the engagement of a pin, not shown, which maintains this body 1 in the frame of the lock, while an orifice 51, pierced in each of these cheeks 52' and 49' allows the assembly of these latter by the introduction of a connecting pin or a similar member, not shown, and the fixing of the lock in a door.

Allowing the operation of the lock according to the invention, the key 9 comprises a massive cylindrical body 41 attached to its head 44 by a neck 45 and having five longitudinal splines 11 with an arched cross section in a circle arc and distributed angularly by sixty degrees from the lower half plane of symmetry of the key, the first, 11*a*, and the fifth, 11*b*, of these splines being separated angularly by one hundred and five degrees at the basee 42 of the body 41 of the key, in which base 42 is provided a shallow hollow 40 made radially along this lower half plane of symmetry of the key and allowing, by the introduction of the head 32 of the stopping finger 30, the locking of the key 9 in the barrel during the operation of the lock. Profiles 43, formed longitudinally in the body 41 of the key in front of each of the splines 11, result from the truncation of these latter for the coding of the key. A special key is provided to enable the introduction, the extraction or the reintroduction of the barrel in the body 1. Coded to the combination or to one of the combinations of the lock, this special key is provided with a hollow 40 of sufficient depth so that the base 31 of the stopping finger 30 can be entirely disengaged from the second annular slot 36 under the action of the return spring 35 during the introduction or the extraction of the barrel.

According to an essential characteristic of the invention, the coding of the lock is done directly from the combination on the key. The process used consists, with the barrel extracted from the body, of equipping the said longitudinal recesses 3 with unnotched tumblers 4, of introducing and of maintaining the key 9 engaged fully in the barrel and then, by a conventional turning process wherein a turning tool is inserted within the annular groove 17 carried by the middle part the barrel, of simultaneously forming the notches 18 of these tumblers 4. The coding of the lock is thus achieved quickly and very accurately, the splines 11 of the key 9 holding the tumblers 4 exactly in their position for the operation of the lock during the formation of their notches. Other codes for the same lock corresponding to the combinations of other keys also enabling the operation of the lock, at least one of which is a master key common to several locks and a special extraction key, are also possible by the successive formation of notches 18 in the same tumblers of the lock.

According to a variant of this coding process, the annular groove 17 carried on the middle part of the barrel is made by the turning technique simultaneously with the formation of the notches 18 of the tumblers 4 corresponding to a first coding of the lock.

Referring now to FIGS. 3 to 8, and according to the second embodiment, with a double key entry, the lock according to the invention comprises two bodies 1 identical to that of the lock according to the first embodiment, assembled in opposition by the frame of the lock and in each of which is mounted rotatingly, and removably toward the front of the body, a barrel 2' longer than this body, as well as a single latch holder 7 mounted to turn in the manner of a sleeve, on either side of its diametral partition 61, on the rear part of each of these two barrels 2' with each of which, alternatively, this latch holder can be engaged. This latch holder is maintained captive longitudinally between the two bodies 1 whose different elements are given the same references in FIGS. 3 and 8 as in FIGS. 1, 1A and 2.

Each of these barrels 2' is equipped with a washer split into two halves, with tumblers, with tumbler springs, with a retainer and with means for locking the key 9 and for maintaining the barrel longitudinally in the corresponding body, identical to those of the first embodiment of the invention and given the same references as in FIGS. 1, 1A and 2. With the exception of their central part, these two barrels 2' have the same front part 39' and are provided with the same recesses 3', annular grooves 17' and 38', blind holes 26', shaft 33' and neck 34' and equipped with the same tumblers 4 provided with the same return springs 5 and with the same nibs 16 sliding in the same ports 15' as in the first embodiment of the invention of the single key entry type.

The central channel of each of these two barrels 2' is broached to the same profile as the splines 11 of the key 9 along five slots 10' extending over the entire length of the barrel 2', and has a radial inset 76 which separates this central channel into two parts: one, 8', in front, in which the key 9 engages directly through the front, and the other, 8'', in the back, opening at the back of the barrel and in which is slidingly mounted a driver 14' or 14'' whose splines 29' have the same profile (or cross section) as those 11 of the key 9 and which is fixed, by force fitting, by its blind orifice 74 (FIG. 3) on the tail 71 of a pushing member 68 whose middle part 70 slides in this radial inset 76 and whose head 69, against which is applied the end of the key 9, is retained in the front part 8' by this radial inset 76 when this key is fully engaged in the barrel, as is the case in FIG. 8 for the left-hand half of the lock. A helical spring 63, fitted in the back part 8'' of the central channel of the barrel of this left-hand half of the lock and compressed between the said radial inset 76 and the driver 14' contained in the rear part 8' of this barrel, tends to maintain this driver 14' engaged in the broaching 62 of the diametral partition 61 of the latch holder 7. As no corresponding spring is provided for the right-hand half of the lock, the latch holder 7 remains engaged only with the barrel 2' of the left-hand part of the lock, in the absence of the key or when the key 9 is introduced into this latter barrel 2'. Under the action of the key 9 introduced fully into the barrel 2' of the right-hand part of the lock and acting on the corresponding pushing member 68, the driver 14'' carried by this latter pushing member drives out of the broaching 62 the driver 14' carried by the barrel of the left-hand part of the lock and engages, in opposition to the compressed spring 63, only in this broaching 62 of the latch holder 7 which is thus engaged only with the barrel 2' of the right-hand part of the lock as long as the key 9 is maintained there, loaded to return simultaneously by the spring 63 and by the springs 5 associated with the tumblers 4. In order to ensure the angular holding of the latch holder 7 in position during the extraction of one of the barrels 2' from the corresponding body 1, two shallow hollows 58 and 59 (FIG. 3) are made in the front section (toward the left in FIG. 8) of the cylindrical sleeve 22 of the latch holder 7 in which can engage alternately and respectively, depending on whether the barrel which is extracted is that of the right-hand part or that of the left-hand part of the lock, the rounded end of the retaining finger 54 mounted slidingly in the blind hole 53 of the fin 47 of the body 1 of the left-hand part of the lock, slightly thrusted against this front section of the cylindrical sleeve of the latch holder by a return spring 55 fitted in this blind hole 53.

For the clarity of the drawing have been shown in FIG. 4 the bore 75 made in the body 1 or one of the bodies 1 of the lock, and in FIG. 6 the radial inset 76 and the bore 77' of the back part 8'' of a barrel 2' according to the second embodiment of the invention and, in FIGS. 6 and 8 the bore 77 of the front part 8' of this same barrel 2'.

The frame of the lock according to this second embodiment comprises two front walls 64 and 64' each extending opposite each other on either side of the fins 47 of the bodies 1 by a cheek whose middle part is pierced with an upper window 65 in which can pass the latch 56, and with orifices 66, 66' and 78, the first two, on each of the cheeks 64 and 64', allowing the introduction of pins 67 into the corresponding orifice 48 of each of these fins 47 to hold the body 1 and, the third, 78, on each of the cheeks, enabling the lock to be fixed in a door, by a connection pin or a similar device, not shown.

The coding process for the lock according to this second embodiment of the invention, with a double key entry, is evidently the same as that described for the first single key entry embodiment.

Finally, the two preferred embodiments of the invention described and shown in the drawing are intended to be illustrative examples, so that it is possible for those skilled in the art to make any modifications in form or detail or to replace any or all of the constituent elements by equivalent elements without departing from the scope of the invention.

I claim:

1. A bar-tumbler safety lock comprising:

a hollow body having an opening at a front end thereof, a barrel shaped to move into the said opening in the body and rotatably mounted therein, a plurality of recesses extending longitudinally along an outward portion of the barrel, a bar-tumbler longitudinally slidable in each recess, in a first direction, and return means for opposing movement of the tumblers in said first direction, said bar-tumblers each including an operative notch therein, a split washer located within the body at an operative position surrounding the barrel, the outer periphery of the washer engaging the body so as to be stationary against rotation relative to the body but movable longitudinally therein from said operative position to said opening, portions of the inner periphery of the washer being located inwardly of the outermost portions of the tumblers, but outwardly of the portions of said tumblers exposed by said operative notches, whereby when operative notches of the tumblers are longitudinally aligned with the washer, the barrel can rotate relative to the washer and the body, a radially extending annular groove formed in the barrel at a location intermediate to the ends thereof and receiving said split washer therein, said annular groove opening into said recesses and permitting access to said tumblers when the barrel is removed from the body, the width of said groove being no greater than the widths of the operative notches of the tumblers, a latch holder operatively engaged with the barrel to rotate therewith, said barrel with said washer being movable as a unit out of said front opening of the body, and a restraining means for preventing longitudinal movement of the barrel out the front opening of the body in the normal rest position of the barrel in the body and for releasing the barrel for removal longitudinally out of the body at a certain given rotary position of the barrel, angularly displaced from said normal rest position.

2. A bar-tumbler safety lock according to claim 1, said restraining means comprising a stud extending radially out from said barrel into an annular slot in the body which normally prevents longitudinal movement of the stud and hence also of the barrel, and including a longitudinally extending slot intersecting said annular slot at an angular position which the said stud reaches only upon rotation of the barrel to said certain given angular position, whereby the stud can move along the longitudinal slot upon removal of the barrel from the body.

3. A bar-tumbler safety lock according to claim 1, the barrel having a central key-reception channel open toward the front and shaped to the profile of the key, a stop finger mounted slidingly in an opening made radially through the barrel and opening into the said central channel, said stop finger being movable outwardly in the said opening in opposition to the return means urging it toward the axis of the channel, a second annular slot made radially in the front part of the internal surface of the body, at the level of said opening when the barrel is in place, and in which, with the key fully engaged, is secured the base of the said finger which then assists to retain the barrel inside the body, even in the said given angular position of the latter.

4. A bar-tumbler safety lock according to claim 3, the key and the barrel having a common plane of symmetry, said stud and said key being located along the lower half-plane of symmetry of the barrel, and including a key having a depression to receive said stop finger when in the barrel, to remove the stop finger from engaging with the body to permit removal of the barrel from the body at said given angular position.

5. Bar-tumbler type safety lock according to claim 4, characterised by the fact that the means for locking the key inside the barrel during the operation of the lock comprises a hollow of small depth made radially in the key at the level of its lower generatrix; the said stop finger; the second annular slot and one or more orifices for the exterior disengagement of the base of this finger in opposition to its return means, pierced at the bottom of this second annular slot, the first along the lower half-plane of symmetry of the body, the others each at the level of the bottom of one of the slots constituting the broaching of this body; the assembly is arranged so that the key inserted in the barrel retracts the finger in the opening, the base of this finger engaging one of these orifices, and then when fully engaged in the barrel, allows the head of the finger to engage in the said hollow and allows the base of the finger to become disengaged, under the action of its return means, from this orifice and to be maintained by the bottom of the second slot, the key remaining locked by the finger during the rotation of the barrel from which the key is disengaged only in an angular position of the barrel in which the finger is aligned with another orifice or, after a complete rotation of the barrel, with the same orifice, threby allowing the finger to retract before the key which can only then be removed from the barrel.

6. Bar-tumbler type safety lock according to claim 5, characterised by the fact that the said return means of the stop finger are constituted by an annular spring placed in extension at the interior of an annular groove made in the periphery of the front part of the barrel and traversing a slot formed in the base of the finger.

7. Bar-tumbler type safety lock according to claim 1, characterised by the fact that, the barrel has a length longer than that of the body, the latch holder turns in the manner of a sleeve on the rear end of the barrel which drives it rotation indirectly through a drive member engaged rotatingly with the barrel in an internal broaching of the rear part of the barrel, means being provided for angularly maintaining the latch holer in position when the barrel is removed from the body.

8. Bar-tumbler type safety lock according to claim 1, characterised by the fact that the said longitudinal recesses in which the tumblers slide are blind cylindrical holes opening at the rear of the barrel and that these tumblers are massive cylindrical blocks the front part of which laterally carries a nib on which acts the corresponding spline of the key and in the body of each of which, in addition to one or more coding notches, are radially provided several annular grooves constituting false notches intended to mask the real position of the coding notch(s) of the tumbler when an attempt is made to pick the lock, the said return means of the tumblers being composed of helical springs each placed in one of the said recesses, directly behind the tumbler, and retained at the bottom of the recess by an annular member or retainer which simultaneously blocks all these recesses behind the barrel in which this retainer can be crimped and which is provided with a central opening traversed by the driver.

9. Bar-tumbler type safety lock according to cliam 1, with a single key entry, provided with a single body and a single barrel and characterised by the fact that the central channel of the barrel, in which the key is directly inserted from the front, is separated from a broaching made in the rear part of this barrel for engaging the latch holder by a massive partition on the front face of which bears directly the end of the key fully engaged in the barrel and the periphery of which is only pierced with longitudinal hollows in which the nibs of the tumbler can engage, said hollows being extended toward the front by longitudinal ports which place each of said recesses of the tumblers in communication with the central channel and in which are guided and slide these nibs of the tumblers.

10. Bar-tumbler type safety lock according to claim 9, characterised by the fact that the driver is partially crimped permanently in the internal broaching of the rear part of the barrel and, with the barrel in place, is maintained engaged in an identical broaching made in the central part of the latch holder, this latch holder being maintained rotatingly on a face of the bottom of the lock.

11. Bar-tumbler type safety lock according to claim 1, with a double key entry, provided with two bodies and two barrels each mounted in one of the bodies and characterised by the fact that the central channel of each of these two barrels, the broaching of which reproduces the profile of the splines of the key, extends longitudinally over the entire length of the barrel and has a radial inset which separates the said central channel into two parts, one in front and in which the key is directly inserted from the front, the other behind and opening at the back of the barrel and in which is slidingly mounted the driver which is provided with splines of the same profile as those of the key and is fitted on the tail of a pushing member whose middle part slides in the said radial inset and whose head, against which bears the end of the key, is retained in the said front part by the said inset when the key is fully engaged; a helical spring, placed in the rear part of the central channel of one of the two barrels around the middle part of the pushing member and compressed between the said radial inset and the driver, tending to maintain the latter engaged in a broaching identical to that of the central channel, made in a diametral partition of the latch holder which, having a symmetrical configuration, turns in the manner of a sleeve on the rear end of each of the two barrels; the assembly is arranged so that, with the barrels in place, the latch holder is maintained, in the absence of the key, engaged with one of the two barrels which is provided with the said helical spring, remains engaged with the latter when the key is engaged in this first barrel and is disengaged from this latter to be engaged with the second barrel under the action of the key inserted fully into this second barrel whose driver, driving that of the first barrel in opposition to the said helical spring, then engages, while held by the key, in the latch holder; means being provided for keeping the two bodies assembled.

12. Key for operating the lock according to claim 3, comprising a massive cylindrical body on the periphery of which are made several splines, truncated at their end over a depth depending on the combination carried by this key and regularly distributed angularly, a higher angular distance being allowed at the base of this body between the first and the last of these splines, characterised by the fact that the said splines have an arched cross section and by the fact that a hollow of small depth, shaped to receive the head of the stop finger locking the key in the barrel, is made radially in the key body along its lower generatrix; and including profiles, formed longitudinally in this body in front of each of the splines, resulting from their truncation for the coding of the key.

13. Key according to claim 12, specially designed to enable the introduction, the extraction or the reintroduction of the barrel in the body, characterised by the fact that its hollow is made with a depth such that the head of the stopping finger can be introduced sufficiently so that the base of this finger is disengaged from the second annular slot during this introduction, this extraction or this reintroduction of the barrel in the body.

* * * * *